United States Patent [19]

Baxter

[11] Patent Number: 4,718,807

[45] Date of Patent: Jan. 12, 1988

[54] SIGNATURE STACKING APPARATUS

[75] Inventor: Michael S. Baxter, Swanton, Vt.

[73] Assignee: Harris Graphics Corporation, Melbourne, Fla.

[21] Appl. No.: 885,268

[22] Filed: Jul. 14, 1986

[51] Int. Cl.[4] ..... B65H 31/34

[52] U.S. Cl. ..... 414/36; 271/178; 414/90; 414/907

[58] Field of Search ..... 414/30, 36, 86, 90, 414/907; 271/177, 178; 100/173, 210

[56] References Cited

U.S. PATENT DOCUMENTS

| | | | |
|---|---|---|---|
| 3,331,516 | 7/1967 | Gubeli | 414/36 |
| 3,516,657 | 6/1970 | Knudsen | 271/178 X |
| 3,617,055 | 11/1971 | Stal | 414/30 X |
| 3,717,075 | 2/1973 | Lopez | 414/36 X |
| 3,905,487 | 9/1975 | Hoke et al. | 414/36 |
| 4,197,045 | 4/1980 | Stauber | 414/907 X |
| 4,296,684 | 10/1981 | Wangermann | 414/907 X |
| 4,428,574 | 1/1984 | Kataoka | 271/178 X |
| 4,570,922 | 2/1986 | Akers | 271/178 |

FOREIGN PATENT DOCUMENTS

| | | | |
|---|---|---|---|
| 1136703 | 12/1968 | United Kingdom | 271/178 |

OTHER PUBLICATIONS

I.B.M. Technical Disclosure Bulletin, vol. 23, No. 3, pp. 951 & 952, Aug. 1980.

*Primary Examiner*—Leslie J. Paperner

*Attorney, Agent, or Firm*—Tarolli, Sundheim & Covell

[57] ABSTRACT

An improved signature stacking apparatus includes an assembly which feeds signatures across a stack of signatures toward a register surface. As the signatures are moving toward the register surface, they are engaged by a precompressor assembly which applies a force to a leading end portion at each of the signatures in turn to urge the signature forwardly against the register surface and to press the leading end portion of each signature downwardly against other signatures in the stack of signatures. The precompressor assembly incudes a pair of arcuate paddles which extend outwardly from a rotatable hub. The speed of rotation of the hub is such that outer side surface areas of the paddles are moving at a speed which is greater than the speed of movement of the leading end portion of the signatures. Therefore, upon engagement of an outer side surface area of a paddle with a signature, the signature is accelerated toward the register surface. At the same time, the paddle applies a downward force against the leading end portion of the signature to press the signature downwardly toward the stack of signatures.

4 Claims, 5 Drawing Figures

SIGNATURE STACKING APPARATUS

BACKGROUND OF THE INVENTION

This invention relates generally to an apparatus for forming stacks of newspapers and signatures.

An apparatus for forming stacks of newspapers and signatures is disclosed in U.S. Pat. No. 4,401,021. The apparatus disclosed in this patent includes a stacker assembly having an infeed section which feeds folded newspapers in a shingled stream to a stacker section. The stacker section includes a plurality of support platforms on which newspapers are stacked. After a stack of newspapers of a desired count has been formed, the stack of newspapers is discharged from the stacker section.

During operation of a stacker assembly similar to the one shown in U.S. Pat. No. 4,401,021, the relatively thick folded end portions of the newspapers tend to result in the formation of an uneven stack. Thus, the top of the stack will be higher in the area of the folded end portions of the newspapers and lower in the area of the cut or open end portions of the newspapers. The uneven thickness of the newspapers makes the forming and handling of a tall stack rather difficult.

BRIEF SUMMARY OF THE INVENTION

The present invention provides a new and improved signature stacking apparatus which is operable to stack signatures having folded end portions, in relatively tall and even stacks. As each of the newspapers or signatures in turn moves over the stack, it is engaged by a precompressor assembly. The precompressor assembly urges the folded leading end portion of the signature into abutting engagement with a register surface and presses the leading end portion of the signature downwardly against the stack of signatures. This results in the leading end portion of the signature being accurately registered relative to the other signatures in the stack and in the folded leading end portion of the signature being compressed to eliminate unnecessary bulk. Since the leading end portion of the signature is accurately registered and compressed, a relatively even stack results. This even stack can be made relatively tall without encountering undue handling difficulties.

The precompressor assembly includes a rotatable hub from which arcuate paddles extend. The hub is rotated fast enough so that outer side surface areas of the paddles move faster than the leading end portions of the signatures as they cross the stack. Therefore, the outer side surface areas of the paddles sequentially press the signatures downwardly and forwardly.

A counterbalance assembly is provided to control the amount of downward force applied by the paddles against the signatures. In addition, a sensor detects the level of the hub and effects operation of a drive assembly in the stacker to maintain the level of the top of the stack substanlially constant as the stack is built up.

Accordingly, it is an object of this invention to provide a new and improved apparatus for use in forming a stack of newspapers or signatures and wherein the apparatus includes a precompressor assembly which applies force to a leading end portion of each of the signatures in turn to urge each signature forwardly against a register surface and to press the leading end portion of each signature downwardly against a stack of signatures.

BRIEF DESCRIPTION OF THE DRAWINGS

The foregoing and other objects and features of the present invention will become more apparent upon a consideration of the following description taken in connection with the accompanying drawings wherein.

DESCRIPTION OF ONE SPECIFIC PREFERRED EMBODIMENT OF THE INVENTION

Figure 1:
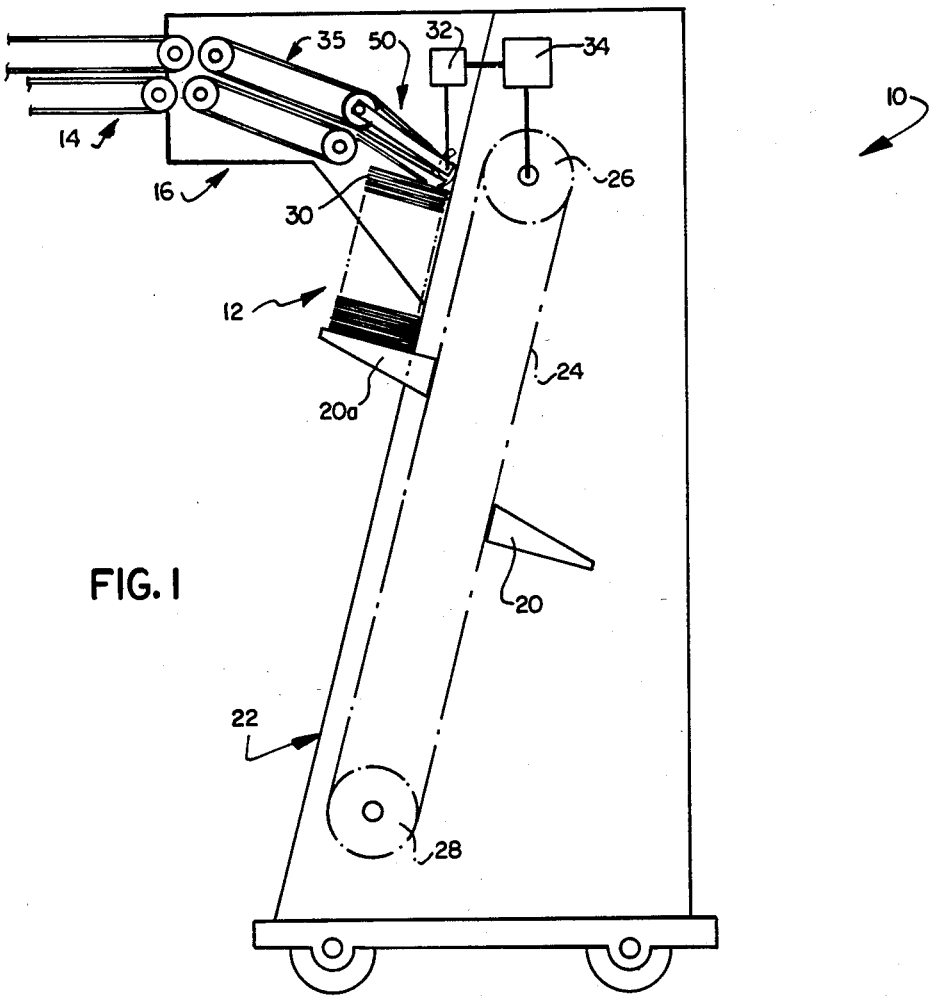
FIG. 1 is a schematic side view of a stacker assembly which is constructed and operated in accordance with the present invention to form a stack of signatures.

A stacker assembly 10 (FIG. 1) is used to form a stack 12 of folded signatures, such as newspapers, booklets or other sheet material items. A conveyor assembly 14 conducts the signatures to an infeed section 16 of the stacker assembly 10 in an overlapped stream. The infeed section sequentially feeds the signatures onto any one of a plurality of supports 20 in a stacker section 22. It should be understood that although only a pair of supports 20 have been shown in FIG. 1, additional supports, for example four supports, are connected with a chain 24 which extends around rotatable sprockets 26 and 28.

As the stack 12 is accumulated on one of the supports, for example the support **20*a* in FIG. 1, the sprockets 26 and 28 are rotated to move the chain 24 to maintain the level of the upper surface of the stack 12 constant. Thus, as signatures 30 are fed onto the stack 12, a sensor 32 detects the rising level of the stack and effects operation of controls 34 to cause a motor to rotate the sprockets 26 and 28 to lower the support arm 20*a*. The general construction and mode of operation of the stacker assembly 10** is the same as is described in U.S. Pat. No. 4,401,021.

During operation of the stacker assembly 10, the conveyor assembly 14 feeds signatures in an overlapped stream to the infeed section 16 with folded end portions of the signatures leading. The infeed section 16 includes an infeed conveyor 34 which feeds each of the signatures 30 in turn across the stack 12 (see FIG. 2) with a folded end portion 38 of the signature leading. The folded leading end portion 38 of the signature engages a register surface 42 (FIG. 2) on a register member 44 to stop forward movement of the signature 30 with the folded end portion 38 aligned with the folded end portions 38 of other signatures on the stack 12. A jogger assembly (not shown) is advantageously provided adjacent to the edge portion of the stack 12 opposite from the register member 44 to further promote the alignment of the signatures 30.

In accordance with a feature of the present invention, a precompressor assembly 50 (FIG. 2) is provided to urge the folded leading end portion 38 of each signature in turn against a register surface 42 and to press the leading end portion of each signature downwardly against other signatures in the stack 12. The precompressor assembly 50 includes a plurality of arcuate paddles or blades 54 and 56 which are connected with a rotatable hub 58. The hub 58 rotates, in a counterclockwise direction as viewed in FIG. 2, about a central axis which is perpendicular to the path of travel of the signatures 30 across the stack 12 and extends parallel to the register surface 42.

Figures 2, 3:
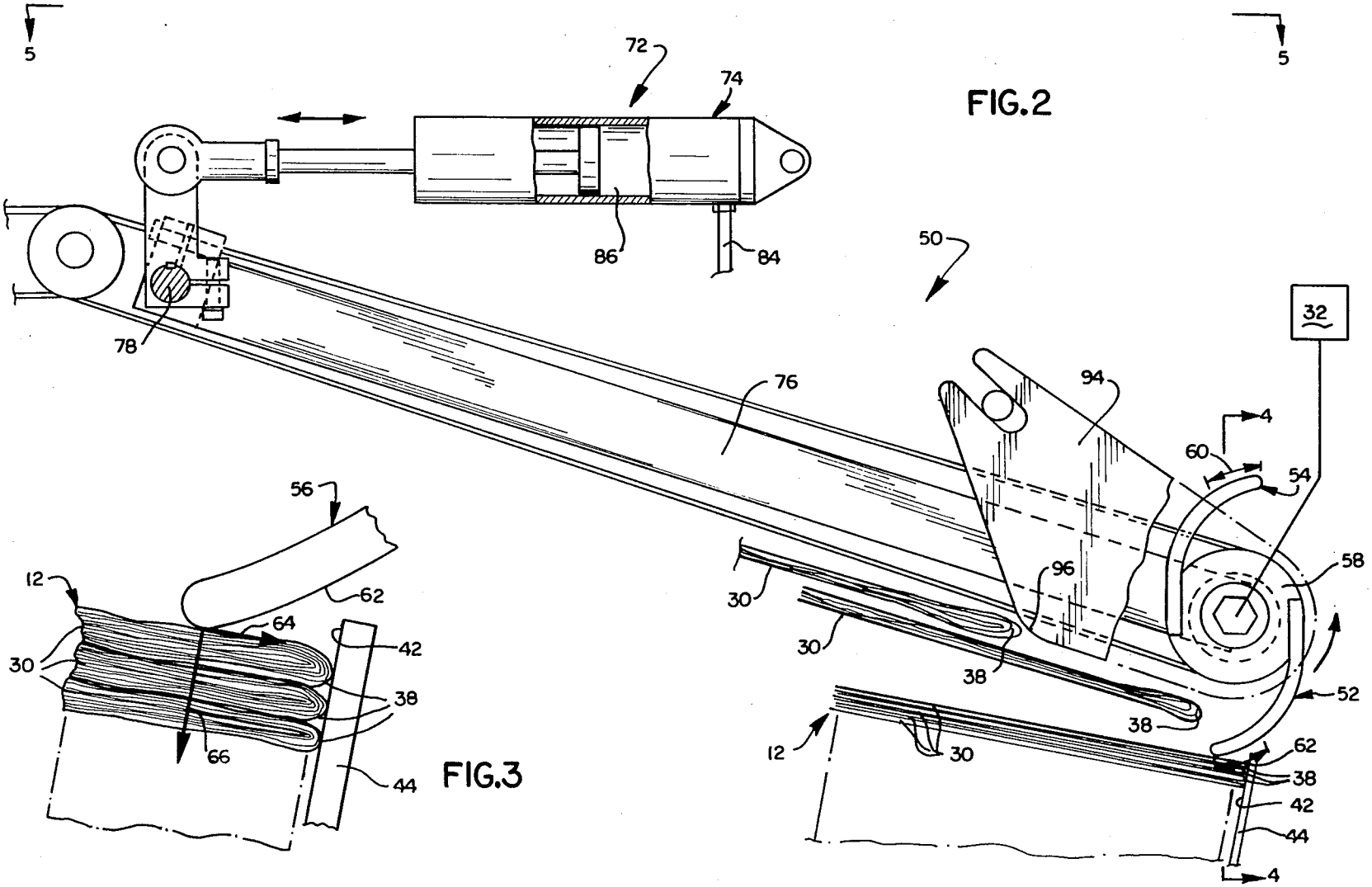
FIG. 2 is an enlarged fragmentary side view of a precompressor assembly which is part of the stacker assembly of FIG. 1.
FIG. 3 is an enlarged schematic fragmentary view illustrating the manner in which a paddle of the precompressor assembly of FIG. 2 applies force to the leading end portion of a signature.

The paddles 54 and 56 have arcuate outer side surface areas, indicated at 60 and 62 in FIG. 2, which sequentially engage the leading end portions 38 of signatures 30 as the signatures move across the stack 12. The speed of rotation of the hub 58 is such that the outer side surface areas 60 and 62 of the paddles 54 and 56 are moving faster than the leading end portion 38 of an engaged signature 30.

Upon engagement of an outer side surface area 60 or 62 of a paddle 54 or 56 with the leading end portion 38 of a signature, the outer side surface area of the paddle has a sideward velocity component in a direction perpendicular to the register surface 42 which is greater than the speed of movement of the signature 30 toward the register surface. This results in the signature 30 being accelerated toward and pressed against the register surface 42. By pressing the leading end portion 38 of each signature 30 in turn against the register surface 42, each signature is accurately positioned relative to the other signatures of the stack 12.

When an outer side surface area 60 or 62 of a paddle 54 or 56 engages the leading end portion 38 of a signature, the outer side surface area of the paddle has a downward velocity component parallel to the register surface. This results in the signature 30 being pressed against the leading end portions 38 of other signatures 30 in the stack 12. By pressing the leading end portion 38 of each sigature 30 in turn downwardly against the stack 12 of signatures, the edge portion of the stack is compressed.

After the leading end portion 38 of a signature 30 has engaged the register surface 42, the surface area 60 or 62 of the paddle 54 or 56 continues to move forwardly and downwardly as the hub 58 continues to rotate. During the resulting sliding movement of the paddle surface area 60 or 62 across the upper surface of the leading end portion 38 of the signature, air is forced out from between the sheets of the signature. This eliminates excessive bulk from the leading end portion 38 of the signature. Therefore, the stack 12 is relatively even, that is, the top and bottom surfaces of the stack are relatively close to being parallel.

During operation of the stacker assembly 10 signatures 30 are fed in an overlapped stream from the conveyor assembly 14 to the infeed conveyor 34. The infeed conveyor 34 feeds each of the signatures 30 in turn over the stack 12 in a direction toward the register surface 42. While the leading end portion 38 of a signature 30 is spaced from the stack 12 and the register surface 42, the outer side surface area 62 on the paddle 56 engages the upper surface of the leading end portion 38 of the signature and applies a friction force component 64 (FIG. 3) against the upper side surface of the signature. The friction force component 64 urges the signature 30 toward the register surface 42.

As the leading end portion 38 of the signature 30 is moving toward the register surface 42, the outer side surface area 62 of the paddle 56 is pressing the leading end portion 38 of the signature 30 downwardly against the other signatures in the stack 12 with downward force component 66 (FIG. 3). The downward force component 66 compresses the leading end portion 38 of the signature 30.

Upon egagement of the leading end portion 38 of the signature with the register surface 42, forward movement of the signature 30 stops. However, the paddle 56 continues to press the leading end portion 38 of the signature downwardly against the stack 12 and to wipe across the upper side surface of the signature 30 with a force sufficient to force air from between sheets of the signature. This eliminates any unnecessary bulk from the folded leading end portion 38 of the signature. The resulting stack 12 has a relatively uniform height rather than being built up in the area of the folded leading end portions 38 of the signatures 30.

The register member 44 has a plurality of sections which are disposed adjacent to axially opposite ends of the paddles 54 and 56. The paddles 54 and 56 are movable through an opening between the sections of the register member 44. This allows the paddles 54 and 56 to wipe or press downwardly against the leading end portions 38 of the signatures 30 adjacent to the fold.

When the paddle 56 is being moved across the upper side surface of a signature 30, it is important that the friction force component 64 (FIG. 3) applied against the signature does not rip the top sheet of the signature. Since the friction force component 64 between the paddle 56 and the outer side surface of a signature 30 will vary as a function of the downward force component 66, a counterbalance assembly 72 (FIG. 2) is provided to regulate the force 66 with which the outer side surface area 62 of the paddle 56 presses the leading end portion 38 of the signature 30 downwardly. The counterbalance assembly 72 includes a piston and cylinder 74 which is connected with a support arm 76 upon which the hub 58 is rotatably mounted. The maximum force 66 with which the paddle 56 can press downwardly against the stack 12 of signatures is a function of the weight of the precompressor 50. Thus, a precompressor support arm 76 (FIG. 2) is mounted on a pivot shaft 78. In the absence of fluid pressure in the piston and cylinder 74, the weight of the various components of the precompressor assembly 50 press the paddle surface 62 against the upper signature 30 on the stack 12 with a maximum downward force component 66. However, by conducting fluid pressure through a conduit 84 to a head end chamber 86 of the piston and cylinder 74, a counterclockwise force is applied to the support shaft 78 to reduce the downward force 66 applied by the paddle 56 against the signature 30. The fluid pressure in the head end chamber 86 of the piston and cylinder 74 can be regulated to reduce the force component 66 to a very small downward force which will not damage relatively delicate sheet material.

Although only the paddle 56 has been illustrated in FIG. 3, it should be understood that the paddle 54 has the same construction as the paddle 56 and applies force components against a signature in the same manner. It is preferred to form the paddles 54 and 56 out of relatively rigid pieces of metal. However, the paddles 54 and 56 could be designed to flex under the influence of the force components 64 and 66 and could be made of materials other than metal.

Figure 4:
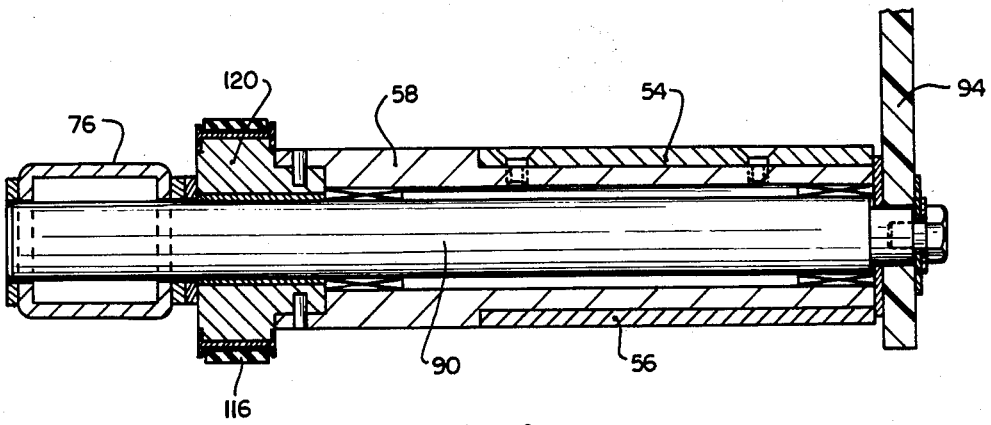
FIG. 4 is a fragmentary sectional view, taken generally along the line 4—4 of FIG. 3, illustrating the manner in which the paddles of the precompressor assembly are mounted on a rotatable hub.

The hub 58 (FIG. 4) is rotatably mounted on a support shaft 90 which extends outwardly from the support arm 76. A deflector plate 94 is mounted on the outer end of the shaft 90 and has a downwardly facing surface 96 (FIG. 2). The deflector surface 96 engages each of the signatures 30 in turn and deflects them downwardly toward the stack 12.

Figure 5:
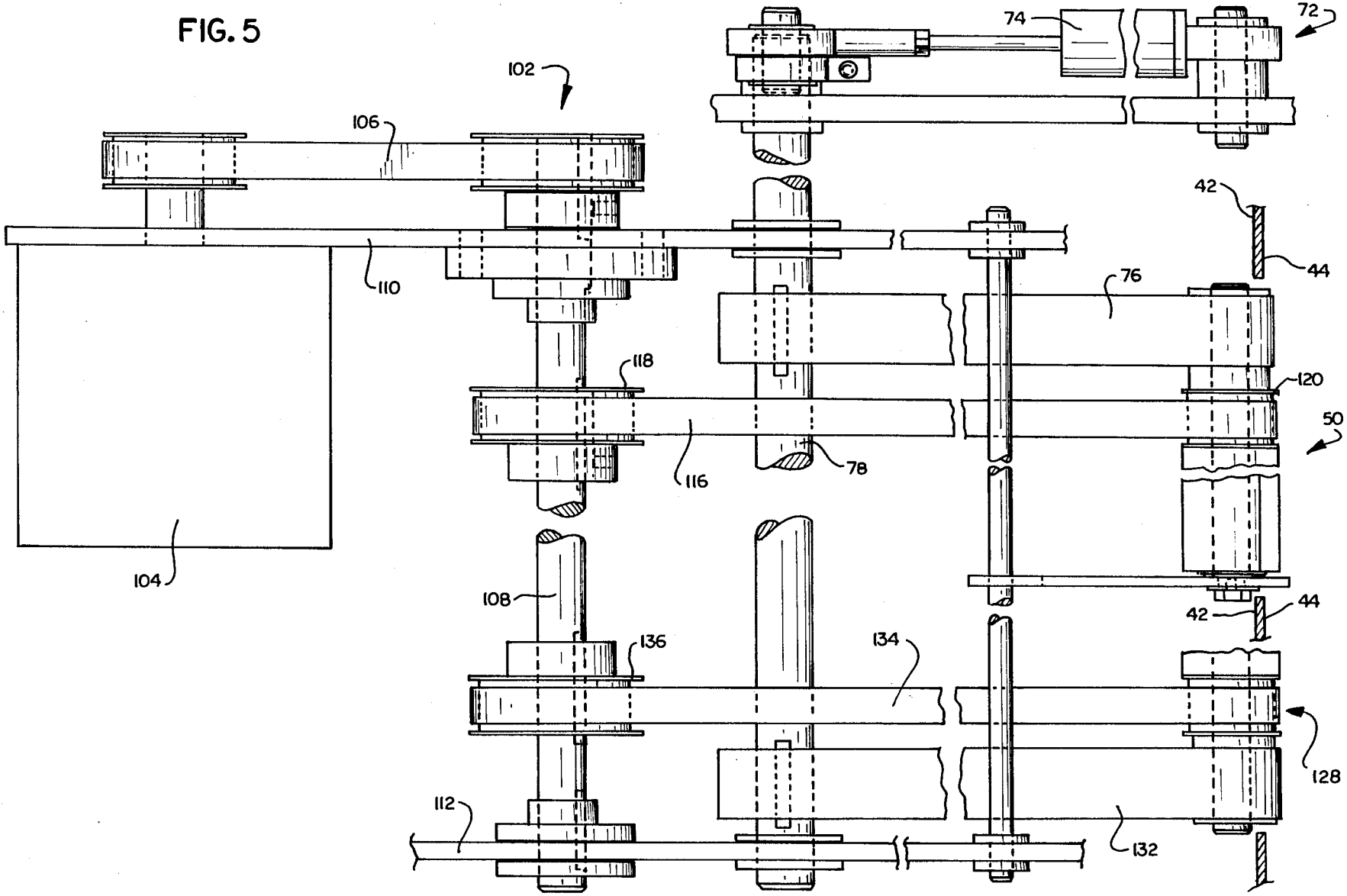
FIG. 5 is a fragmentary plan view, taken generally along the line 5—5 of FIG. 4, illustrating the manner in which a motor is drivingly connected with the precompressor assembly.

A drive assembly 102 for rotating the precompressor paddles 54 and 56 is illustrated in FIG. 5. The drive assembly 102 includes a motor 104 which is connected by a belt 106 with a drive shaft 108. The drive shaft 108 is rotatably supported by side frame members 110 and 112. A drive belt 116 extends from a pulley 118 fixedly connected with the drive shaft 108 to a pulley 120 connected with the hub 58.

Operation of the motor 104 rotates the shaft 108 through the belt 106. This rotational movement is transmitted to the hub pulley 120 by the belt 116. Rotation of the hub pulley 120 rotates the paddles 54 and 56 in a counterclockwise direction (as viewed in FIG. 3) to urge each of the signatures in turn against the register surface 42 and press the signatures against the stack 12.

Although a single precompressor assembly 50 could be utilized if desired, it is contemplated that two or more precompressor assemblies will be utilized to apply force against spaced apart locations on the leading end portion 38 of each of the signatures 30 in turn. Thus, a second precompressor assembly 128 (FIG. 5) is provided in axial alignment with the first precompressor assembly 50. Of course, additional precompressor assemblies could be provided between the precompressor assemblies 50 and 128 if desired. The precompressor assembly 128 is supported by an arm 132 and is driven by a belt 134 connected with a pulley 136 on the drive shaft 108.

In view of the foregoing description, it is apparent that the present invention provides a new and improved signature stacking apparatus 10 which is operable to stack signatures 30, such as newspapers, having folded end portions 38, in relatively tall and even stacks 12. As each of the signatures 30 in turn moves over the stack 12, it is engaged by a precompressor assembly 50. The precompressor assembly 50 urges the folded leading end portion 38 of the signature 30 into abutting engagement with a register surface 42 and presses the leading end portion 38 of the signature 30 downwardly against the stack 12 of signatures. This results in the leading end portion 38 of the signature 30 being accurately registered relative to the other signatures in the stack 12 and in the folded leading end portion of the signature being compressed to eliminate unnecessary bulk. Since the leading end portion 38 of the signature 30 is accurately registered and compressed, a relatively even stack 12 results. This even stack 12 can be made relatively tall without encountering undue handling difficulties.

The precompressor assembly 50 includes a rotatable hub 58 from which arcuate paddles or blades 54 and 56 extend. The hub 58 is rotated fast enough so that outer side surface areas 60 and 62 of the paddles 54 and 56 move faster than the leading end portions 38 of the signatures 30 as they cross the stack 12. Therefore, the outer side surface areas 60 and 62 of the paddles 54 and 56 sequentially press the signatures 30 downwardly with a force component 66 and forwardly with a force component 64.

A counterbalance assembly 72 is provided to control the amount of downward force 66 applied by the paddles 54 and 56 against the signatures 30. In addition, a sensor 32 detects the level of the hub 58 and effects operation of a drive assembly 34 in the stacker 10 to maintain the level of the top of the stack 12 substantially constant as the stack is built up.

Having described one specific preferred embodiment of the invention, the following is claimed:

1. An apparatus for use in forming a stack of signatures, said apparatus comprising support means for supporting the stack of signatures, a register surface disposed adjacent to said support means, signature feed means for sequentially feeding signatures forwardly across the stack of signatures toward said register surface, and precompressor means for applying a force to a leading end portion of each of the signatures in turn to urge each signature forwardly against the register surface and to press the leading end portion of each signature downwardly against other signatures in the stack of signatures, said precompressor means including a movable member having an outer side surface area engageable with the leading end portion of each of the signatures in turn, drive means for moving said outer side surface area of said movable member into engagement with the leading end portion of a signature and for moving said outer side surface area of said movable member forwardly toward said register surface and downwardly toward the stack of signatures while said outer side surface area of said movable member is in engagement with the leading end portion of the signature, said signature feed means being operable to feed the signatures forwardly across the stack with the leading end portion of each signature traveling at a first speed, said drive means being operable to move the outer side surface area of said movable member forwardly toward the register surface and downwardly toward the stack of signatures at a second speed which is greater than the first speed to thereby tend to accelerate a signature engaged by said outer side surface area.

2. An apparatus as set forth in claim 1 further including support level control means connected with said support means for lowering said support means as signatures accumulate on the stack of signatures.

3. An apparatus as set forth in claim 1 wherein said precompressor means includes a rotatable hub, a plurality of arcuate paddles projecting outwardly from said hub, means for supporting said hub and paddles for rotation about an axis extending transversely to the direction in which signatures are fed by said signature feed means, said means for supporting said hub and paddles including means for supporting said hub and paddles above the leading end portions of the signatures in the stack of signatures and drive means for rotating said hub and paddles relative to the stack of signatures.

4. A stacker for stacking folded signatures, said stacker comprising:

a support onto which the signatures are fed;

means for lowering said support as signatures are fed thereon to form a stack;

at least one precompressor for engaging the folded end portions of the signatures and applying a downward force thereto to flatten the top of the stack on said support, said precompressor comprising at least one pair of paddles having curved surfaces for engaging the folded leading end portion of the top signature on the stack; and means for rotating said paddles about an axis as the signatures are fed to said support, said means for rotating said paddles about said axis maintaining the rotational speed of said paddles to have a linear velocity component near the periphery of said paddles greater than the velocity of the signatures fed onto the stack.

* * * * *